United States Patent [19]

Linzberger

[11] 4,434,522

[45] Mar. 6, 1984

[54] KNIFE SCRAPER FOR DRUMS, PARTICULARLY THE DRUMS OF A CYLINDER MILL

[75] Inventor: Robert Linzberger, Abtwil, Switzerland

[73] Assignee: Gebruder Buhler AG, Uzwil, Switzerland

[21] Appl. No.: 330,312

[22] PCT Filed: May 19, 1981

[86] PCT No.: PCT/EP81/00049

§ 371 Date: Dec. 11, 1981

§ 102(e) Date: Dec. 11, 1981

[87] PCT Pub. No.: WO81/03289

PCT Pub. Date: Nov. 26, 1981

[30] Foreign Application Priority Data

May 10, 1980 [CH] Switzerland ..... 3913/80
Jun. 25, 1980 [DE] Fed. Rep. of Germany ..... 3023824

[51] Int. Cl.[3] ..... B02C 4/40
[52] U.S. Cl. ..... 15/256.51; 101/157
[58] Field of Search ..... 15/256.51; 101/157, 101/169, 425; 355/15; 118/652

[56] References Cited

U.S. PATENT DOCUMENTS

| | | | |
|---|---|---|---|
| 743,955 | 11/1903 | Thompson | 15/256.51 |
| 1,411,907 | 4/1922 | Brunner | 15/256.51 |
| 2,399,538 | 4/1946 | Berry | 15/256.51 |
| 3,040,442 | 6/1962 | Overton | 101/169 X |
| 3,378,876 | 4/1968 | Sisson | 15/256.51 |

*Primary Examiner*—Edward L. Roberts
*Attorney, Agent, or Firm*—Oblon, Fisher, Spivak, McClelland & Maier

[57] ABSTRACT

A knife scraper for rotating drums, particularly for the drums of a cylinder mill, which exhibits a knife beam (5) in which the knife (3) is mounted as well as a counterweight (12) for pressing the knife (3) on the associated drum (1, 1'). In order to make it especially simple and quick to adjust the knife (5) while simultaneously keeping the installation costs and manufacturing costs low and to make the knife (3) essentially self-adjusting in normal operation according to the invention, several mechanical tension elements (11–15) are provided along the length of the knife (3) by means of which by slightly elastically bending the knife surface (F) extending beyond the knife beam (5) the cutting edge (4) of the knife (3) can be pressed against the drum (1, 1').

9 Claims, 2 Drawing Figures

KNIFE SCRAPER FOR DRUMS, PARTICULARLY THE DRUMS OF A CYLINDER MILL

DESCRIPTION

1. Technical Field

This invention relates to knife scrapers for rotating drums, particularly the drums of cylinder mills with a knife beam that holds the knife and a counterweight that presses the knife against the associated drum.

2. Background Art

Knife scrapers have been used as auxiliary elements, particularly in milling. Such have been of significant importance for the operating safety of cylinder mills. For the knife scraper to carry out its intended function it is imperative that each knife scraper adequately contact the drum along the entire length of its blade yet only press lightly against it. It is necessary with smooth drums, such as those used to roll grain products to produce powder and flour, etc., that the knife scraper constantly keep the drum free of adhering flour particles in order to prevent the milled product from "rolling up" on the drum. Locally adhering products can lead to a change in the milling conditions and creates the danger that this could damage the drums during the milling process. Thus, it is very important, in the interest of the proper operation of the entire cylinder mill, that the knife scraper function reliably. For this reason such knife scrapers must be constantly aligned and readjusted. One of the essential disadvantages of prior art knife scrapers has been a result of the awkwardness of adjusting the knife, because the knives must be hand adjusted as a rule after the drums are resurfaced and when a new knife is put in. Customarily each knife is very precisely adjusted with a straight edge and an opposing light. If the adjustment is not exactly and immediately true, additional weights, etc. are often used to better forceseat the knife onto the drum, causing certain disadvantages.

In the case of one known knife scraper (CH-A-316 484) a number of pressure pistons are pressed against the knife beam from a support tube that is filled with hydraulic fluid. No matter how carefully all the individual elements of this known device are produced and assembled there is always a cerain leak-loss of hydraulic fluid, which requires constant readjustment. As a result this device is not suited for use for mill drum purposes and it is no longer possible to individually adjust the knife by hand with the prior-known solution. The only way to bring the knife into proper contact along the entire blade length is to simultaneously increase the pressure on all pressure pistons. The danger inherent in this is relatively increased knife wear.

With a prior-known knife scraper (CH-A-328 826) the knife beam is also pressed by individual hydraulic elements in the cutting direction of the knife. But even this solution is unsuitable for mill drum installations. In both cited prior art cases a relatively large-scale construction expenses is necessary with at best less than satisfactorily adequate operation for a mill drum installation.

DISCLOSURE OF INVENTION

Proceding from this point the goal of the invention is to find a knife scraper of the type mentioned at the outset that substantially lacks the disadvantages associated with solutions discussed above, can be installed with little construction expense, is economical to manufacture, and makes it especially possible to easily and quickly adjust the knife. Furthermore, the knife should be constructed so as to be self-adjusting in normal operation.

The invention teaches a solution in the form of a knife scraper of the type discussed at the outset with several mechanical tension elements distributed along the length of the knife by means of which the blade of the knife is pressed against the drum with the additional slight elastic flex of the surface of the knife extending beyond the knife beam. With the knife scraper according to the invention it is possible for even minimally trained service personnel to immediately and exactly adjust the knife scraper. The knife scraper according to the invention is also able to conform to the shape of the knife to the local contour of the drum, to press the knife against the drum to produce the scraping force, with both functions being independantly controlled or controllable. Through the measure according to the invention the knife is also much easier to adapt to the shape of the associated drum than prior art knife scrapers.

The tension elements of a knife scraper according to the invention are advantageously disposed on the knife beam, thereby giving the knife-a thin scraping element-the necessary support and flex over the knife beam. Advantageously the tension elements exhibit at least, three straining screws which hold the counterweight, with an adjustment bolt at the outer end region of the knife and an adjustment bolt in the middle of the knife. Preferably the adjustment bolt should be disposed perpendicular to the knife surface or only slightly tipped towards the perpendicular.

A particularly propitious solution was found by providing the knife of a knife scraper according to the invention with adjustment screws which brace the knife in the direction of the knife surface (and in the direction of the knife edge).

It is especially easy to replace the knife when the knife is loosely laid into the receptacle groove of the knife beam and is preferably braced across the groove by means of a chuck in the form of a flat filler bar.

Furthermore, it is advantageous when the knife is rotatably attached above the knife beam. In addition the counterweight is advantageously adjustably held by the adjustment bolts at a distance from the knife beam, preferably relative to knife beam.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

BEST MODE FOR CARRYING OUT THE INVENTION

Figure 1:
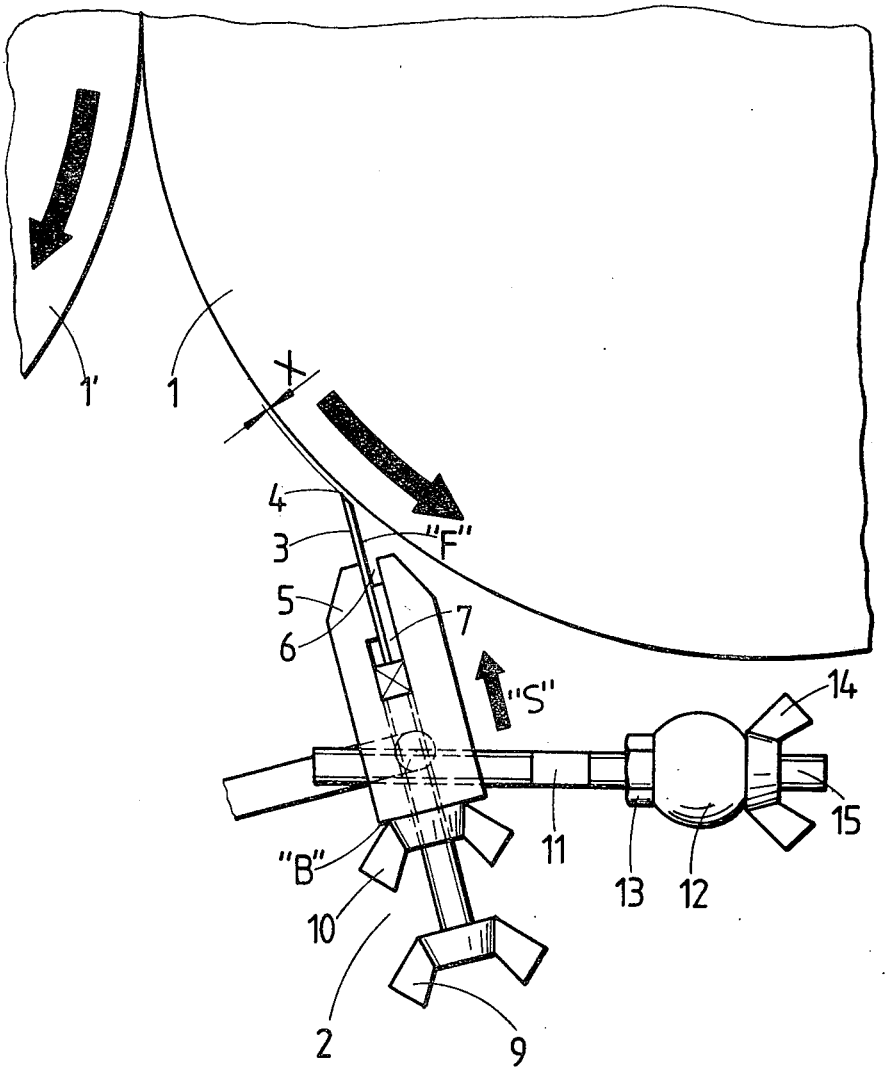
FIG. 1 is a side view of a knife scraper according to the invention.

In FIG. 1 a grinding drum 1 is partially depicted and only a small portion of an additional grinding drum 1' is shown. Generally a separate knife scraper 2 is provided for each drum 1, 1' (diametrically opposite). A knife 3 with a cutting edge 4 is set loosely into the milled slot 6 of a knife beam 5. The knife 3 rests against the one lateral surface of the slot in the knife beam and is held in position by a chuck 7 that is also inserted loosely. Only on one side is there yet a small stop (not shown) which secures the knife 3 against lateral displacement. The knife beam 5 is secured at both ends by pins 8 so that it will rotate and swing somewhat.

The cutting direction of the knife 3 is shown by the arrows S in FIG. 1. The knife beam 5 is relatively large as seen from the cutting direction "S" of the knife 3 and as compared to its width "B". The knife beam 5 is also very inflexible in cuttin direction "S". Along the width "B" of the knife beam 5 seen from the cuttin direction "S" two adjustment bolts 9 are attached along its entire length, which bolts 9 are secured against unwanted loosening by a lock nut 10. At least three tension bolts 11 are provided at an angle not quite 90° to the knife surface F. These tension bolts 11 are at an angle to the knife beam 5 are mounted in openings formed in knife beam 5 and support a counter weight 12 in common. This weight 12 is secured on the thread 15 of the bolts 11 by means of a lock nut 13 and a wing nut 14. Selecting a given length of tension bolts 11 and thread 16 can place the center of the counter weight 12 (compare FIG. 2) at a desired distance A from the pins 8, thus creating the desired pressing force at the cutting edge 4 of the knife 3 against the drum 1.

During operation the cutting edge 4 of the knife 3 constantly presses against the drum 1 with a force corresponding to the given leverage ratios and cleans the drum of adhered flour or grain particles.

Figure 2:
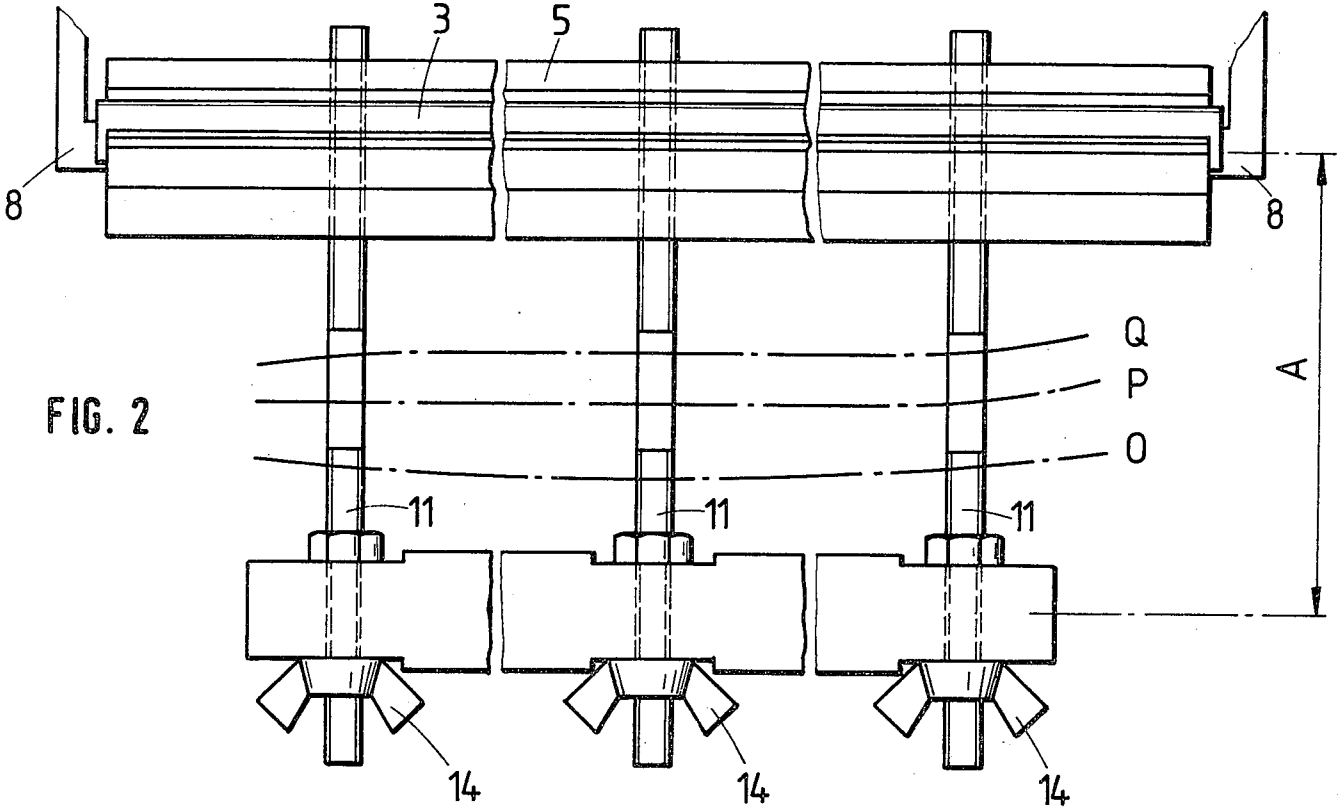
FIG. 2 is a horizontal projection of a knife scraper according to the invention.

After the entire unit has been mounted the knife 3 is adjusted as follows:

Light is produced on the side opposite the knife 3 as it appears to the servicing person when installed, thereby disclosing any possible gap X very quickly and very exactly. By adjusting the lock nut 13 and the wing nut 14, the gap X can be eliminated by corespondingly twisting or bending the knife beam 5 or the thin knife 3 via the shifting of the location of the counterweight 12 and the resulting gravity force vector. FIG. 2 shows three dotted lines O, P and Q as an example of three possible shape changes occuring in the knife.

As far as it relates to the adjustment procedure, it is completely immaterial why the knife does not make contact in any given place, whether this is due to the inexact positioning of the knife, a large irregularity in the drum or inexact placement of the knife beam 5. In any case small adjustments of one or more wing nuts 14 are adequate to bring the knife cutting edge 4 into proper contact along the entire length of the drum 1.

If the entire knife scraper becomes skewed relative to the drum 1, 1' the knife 3 can be tipped to a certain degree in the cutting direction by the wing nut 9. Because the possibilities of adjusting the illustrated knife scraper are different and perform essentially different functions, it is recommended that the knife 3 be first adjusted in the cutting direction "S", e.g. by adjusting one or both adjustment bolts 9 as accurately as possible and only then exactly adjusting the contact between the knife cutting edge 4 and the drum 1 by means of support elements 11, 12, 13, 14 and 15. It is preferable that the knife beam 5 be made of a relatively elastic material, e.g. aluminum, the counterweight 12, in contrast, which also serves simultaneously as a support for the support elements should be made preferably of steel. Using three tension bolts is advantageous, however, more than three bolts can be distributed along the length of the knife.

In addition it is very advantageous not to arrange the individual tension bolts precisely at a 90° angle to the knife surface F, but rather to use an angle somewhat less than normal. Nonetheless the geometric shape of the knife beam 5 creates the desired bowing in the longitudinal direction of the knife blade F through the tension bolts. Using wing nuts for securing as well as adjusting the knife 3 makes it possible to adjust the knife without additional tools in the least amount of time while maintaining a high degree of precision. It is simultaneously possible to adapt the knife from the outset to the surface contour of the drum 1. The knife beam 5, which can have a relatively extensive length of up to ca. 1 m., can be elastically bent with a small force a matter of a few tenths of a millimeter in a skew relative to the drum or even several millimeters as the case may be, while the knife 3 is left subject in the cutting direction and after completed adjustment of the scraper to the interplay of forces arising from the specific use and adjustment of the counter weight 12. The knife 3 touches the grinding drum 1 along its entire length with the desired force.

An advantageous embodiment of the knife scraper according to the invention can also be comprised as follows: By running out the knife surface which extends beyond the knife beam only a short distance, e.g., 1–2 cm. relative to its depth from the recess in the knife beam and simultaneously essentially bending the knife beam, and correspondingly also the knife surface held in it (by means of the support elements). By doing this the knife area of the thin knives which extend beyond the knife beam remains relatively rigid, and there is no danger at all of any undesired knife flutter and the desired bending of the knife is principally taken care of within the knife beam itself. The protruding area of the knife is then elastically bent only a very small amount by its contact with the drum. Such an embodiment makes it possible to use especially thin knives with the desired success provided by the invention without compromising anything else.

Obviously, numerous modifications and variations of the present invention are possible in light of the above teachings. It is therefore to be understood that within the scope of the appended claims, the invention may be practiced otherwise than as specifically described herein.

I claim:

1. A knife scraper for a drum having an axis, particularly for the drum of a cylinder mill, comprising:

a knife having a cutting edge and knife surface;

a bendable knife beam on which said knife is mounted, said knife and knife beam being elongated in the axial direction of said drum;

means pivotally mounting said knife beam for pivotal movement about a pivot axis substantially parallel to said drum axis;

counterweight means operatively associated with said knife beam for pressing the knife on said drum, said counterweight means and said knife being spaced from said pivot axis; and a plurality of tension elements connected to said knife beam along the length of said knife beam and upon which said counterweight means are mounted wherein said knife beam is selectively elastically bendable under the influence of force applied to said tension elements, said knife being positioned relative to said drum such that said entire cutting edge is pressed against said drum by said tension elements.

2. A knife scraper according to claim 1, wherein each of the tension elements cooperatively engage the knife beam.

3. A knife scraper according to claim 1 or 2, wherein said tension elements comprise at least first, second and third tension bolts upon which the counterweight means are mounted.

4. A knife scraper according to claim 3, wherein each of said tension bolts is disposed at a small angle from perpendicular to the knife surface.

5. A knife scraper according to claim 4, further comprising a plurality of knife adjustment bolts operatively associated with the knife and which support the knife in the direction of the knife surface relative to the knife cutting edge.

6. A knife scraper according to claim 5, wherein the knife beam has a groove formed therein and having a width dimension extending normal to a plane defined by said knife, wherein a chuck is positioned in said groove and wherein the knife is fitted within the groove of the knife beam and is braced by said chuck in the direction of the width dimension of the groove.

7. A knife scraper according to claim 3, wherein the tension bolts further comprise means for positioning the counterweight at a predetermined distance from the knife beam.

8. A knife scraper according to claim 7, wherein the tension bolts further comprise means for adjusting the position of the counterweight relative to the knife beam.

9. A knife scraper according to claim 1, wherein the knife surface extends out from the knife beam only a comparatively small distance, and the knife surface is essentially bent within the knife beam by corresponding bending of said knife beam due to the tension elements.

* * * * *